US009994020B2

(12) United States Patent
De Meutter et al.

(10) Patent No.: US 9,994,020 B2
(45) Date of Patent: Jun. 12, 2018

(54) HIGH VISCOSITY JETTING METHOD

(71) Applicant: AGFA GRAPHICS NV, Mortsel (BE)

(72) Inventors: Stefaan De Meutter, Mortsel (BE); Jaroslav Katona, Mortsel (BE); David Tilemans, Mortsel (BE)

(73) Assignee: AGFA NV, Mortsel (BE)

( * ) Notice: Subject to any disclaimer, the term of this patent is extended or adjusted under 35 U.S.C. 154(b) by 0 days. days.

(21) Appl. No.: 15/513,568

(22) PCT Filed: Sep. 21, 2015

(86) PCT No.: PCT/EP2015/071595
§ 371 (c)(1),
(2) Date: Mar. 23, 2017

(87) PCT Pub. No.: WO2016/046128
PCT Pub. Date: Mar. 31, 2016

(65) Prior Publication Data

US 2017/0297334 A1 Oct. 19, 2017

(30) Foreign Application Priority Data

Sep. 26, 2014 (EP) ..... 14186638

(51) Int. Cl.
*B41J 2/14* (2006.01)

(52) U.S. Cl.
CPC ..... *B41J 2/14201* (2013.01)

(58) Field of Classification Search
None
See application file for complete search history.

(56) References Cited

U.S. PATENT DOCUMENTS 7,077,334 B2 * 7/2006 Sachs ..... B41J 2/1429 239/11
2002/0145654 A1 10/2002 Nagashima et al.
2007/0200896 A1 8/2007 Ozawa et al.
2010/0321442 A1 12/2010 Park et al.

FOREIGN PATENT DOCUMENTS

EP 0 835 759 A1 4/1998
EP 1 995 069 A1 11/2008
EP 2 275 262 A1 1/2011
JP 2006-130701 A 5/2006
WO 2011/123120 A1 10/2011

OTHER PUBLICATIONS

IP.com search.*
Official Communication issued in International Patent Application No. PCT/EP2015/071595, dated Nov. 24, 2015.

* cited by examiner

*Primary Examiner* — Lisa M Solomon
(74) *Attorney, Agent, or Firm* — Keating and Bennett, LLP

(57) ABSTRACT

A high viscosity jetting method includes jetting a liquid by a through-flow piezoelectric printhead through a nozzle in a nozzle plate, wherein a section of a nozzle has a shape including an outer edge with a minimum covering circle, the maximum distance from the outer edge to the center of the minimum covering circle is greater than the minimum distance from the outer edge to the center from the minimum covering circle times 1.2, and the jetting viscosity of the liquid is at least 20 mPa·s.

15 Claims, 8 Drawing Sheets

HIGH VISCOSITY JETTING METHOD

CROSS REFERENCE TO RELATED APPLICATIONS

This application is a 371 National Stage Application of PCT/EP2015/071595, filed Sep. 21, 2015. This application claims the benefit of European Application No. 14186638.4, filed Sep. 26, 2014, which is incorporated by reference herein in its entirety.

BACKGROUND OF THE INVENTION

1. Field of the Invention

The invention relates to a jetting method of a liquid wherein the jetting viscosity, i.e. the viscosity at the jetting temperature, is at least 20 mPa·s and wherein the architecture of a piezoelectric printhead and especially a nozzle in the piezoelectric printhead is adapted to jet reliably the liquid with a good performance.

2. Description of the Related Art

Thermal printheads are cheap and disposable and restricted to water based inks (integrated with ink supply). They have been used (for a few decades) in the office (SOHO—printers from HP™, Canon™, Epson™, . . . ) and more recently in commercial/transactional printing such as HP™ T300 and T400. The use of water based resin inks in thermal printheads for the wide format graphics (Sign & Display) market was demonstrated by HP™ on the exhibition drupa 2008.

Piezoelectric printheads are more expensive, require a separate ink supply and are capable to deal with a broad range of ink chemistries (hot melt, water, oil, solvent and UV curable inks). They are also used in commercial/transactional printing in combination with water based inks and to a lesser extent oil based inks. Web fed presses for transactional printing from Océ™, Miyakoshi™, Impika™, Dainippon Screen™ and sheet fed inkjet presses from Fuji™, Landa™ and Screen™ use piezo printheads from Kyocera™, Panasonic™ or Dimatix™ in combination with water based dye or water based pigment inks.

The solvent, UV curable and water based resin inks in piezo printheads are used in the wide format graphics market for applications such as industrial print and sign & display.

Through-flow piezoelectric printheads are predominantly used in the ceramics market with oil based inks. The dominant printhead in the market is Xaar™ 1001. This through-flow piezoelectric printhead is also used in inkjet label presses from Durst™, SPGPrints™, FFEI™ and EFI™ (with UV IJ inks). Toshiba Tec™ through flow printheads are used by Riso Kagaku Corporation™ for IJ office printers with oil based inks.

Typically the jetting viscosity of the state of the art for jettable liquids is from 3 mPa·s to 15 mPa·s. None of the inkjet inks used in the field described above, such as commercial/transactional inkjet printing or wide format inkjet printing have a jetting viscosity larger than 15 mPa·s.

There is a need to improve the performance and cost of the current low viscosity inkjet inks for several applications. An increase of jetting ink viscosity could allow to improve the adhesion on several ink receivers such as textiles or glasses, due to a larger choice in raw materials. This formulation latitude of the jettable liquid allows, for example, to include oligomers and/or polymers and/or pigments in a higher amount. This results in a wider accessible receiver range; reduced odour and migration and improved cure speed for UV curable jettable liquids; environmental, health and safety benefits (EH&S); physical properties benefits; reduced raw material costs and/or reduced ink consumption for higher pigment loads.

Another benefit of higher pigment load for a white UV curable inkjet ink with a jetting viscosity at least 20 mPa·s is the higher opaqueness of the jetted ink layer. In addition, a higher pigment load in an UV curable colour inkjet ink with a jetting viscosity at least 20 mPa·s, allows to reduce the ink layer thickness resulting in improved stretchability and flexibility.

Previous work on higher viscous inks in standard printheads exhibited serious difficulties. The main problem was the formation of satellites and mist particles due to an increased tail length of an inkjet droplet jetted at higher jetting viscosity. An increase of a few mPa·s from 6 mPa·s to 12 mPa·s was sufficient to generate many satellites and mist particles per ink droplet.

Also in literature examples of the increase in tail length and satellite formation with increased jetting viscosity in standard printheads has been disclosed. In FIG. 4.7 of WIJSMAN, HERMAN. Structure and fluid-dynamics in piezo inkjet printheads. Thesis University Twente. 2008., the pinch-off-time of the tail was measured as a function of ink viscosity and surface tension. Higher viscosity and lower surface tension gave rise to an increase in pinch-off-time which negatively influences the jetting performance. As a higher surface tension of the ink would also reduce the adhesion on a wide range of ink receivers, it should be clear that further improvement of jetting performance is still required.

SUMMARY OF THE INVENTION

In order to overcome the problems described above, preferred embodiments of the present invention have been realised by a high viscosity jetting method, as defined below, and a piezoelectric printhead suitable for a high viscosity jetting method, as also defined below.

It was surprisingly found that good performance and reliability for jettable liquids with a jetting viscosity of at least 20 mPa·s could be achieved by modification of the piezoelectric printhead architecture, more specifically the geometry of a nozzle (500) in the piezoelectric printhead.

Especially, a method is preferably performed by a throughflow piezoelectric printhead by a step of recirculating the liquid through the piezoelectric printhead. The high jetting viscosity has to be guaranteed in the piezoelectric printhead else the piezoelectric printhead and or its nozzles can be clogged. It is found that piezoelectric printheads with the specific geometry of the nozzle as in the present invention achieves printability with higher jetting viscosity. The recirculating of the liquid through the piezoelectric printhead is of a very high importance for such piezoelectric printheads to avoid clogging and/or better jetting viscosity controlling in the piezoelectric printhead. Higher the jetting viscosity, closer the ranges to control the jetting viscosity in the piezoelectric printhead.

In the high viscosity jetting method, a liquid is jetted by a piezoelectric printhead through a nozzle (500); wherein a section of a nozzle ($N_S$) has a shape (S) comprising an outer edge ($O_E$) with a minimum covering circle (C); wherein the maximum distance (D) from the outer edge ($O_E$) to the centre (c) of the minimum covering circle (C) is greater or equal than the minimum distance (d) from the outer edge ($O_E$) to the centre (c) from the minimum covering circle (C) times 1.2; and wherein the jetting viscosity of the liquid is from 20 mPa·s, gave a better jetting performance than an outer edge ($O_E$) similar to a circle, as in the state-of-the-art. Probably the differences between the maximum distance (D) and minimum distance (d) guides the liquid while jetting to optimal jetting performance such as drop forming and less or no satellite forming by having smaller pinch-off-times and/or tail length of jetted liquid. In a preferred embodiment the jetting viscosity is from 20 mPa·s to 3,000 mPa·s and in a more preferred embodiment the jetting viscosity is from 25 mPa·s to 1,000 mPa·s and in a most preferred embodiment the jetting viscosity is from 30 mPa·s to 500 mPa·s.

In a preferred embodiment the liquid is jetted by a piezoelectric printhead through a nozzle (500); wherein a section of a nozzle ($N_S$) has a shape (S) comprising an outer edge ($O_E$) with a minimum covering circle (C); wherein the maximum distance (D) from the outer edge ($O_E$) to the centre (c) of the minimum covering circle (C) is greater or equal than the minimum distance (d) from the outer edge ($O_E$) to the centre (c) from the minimum covering circle (C) times the square root of two; and wherein the jetting viscosity of the liquid is from 20 mPa·s, gave a better jetting performance than an outer edge ($O_E$) similar to a circle, as in the state-of-the-art. Probably the differences between the maximum distance (D) and minimum distance (d) guides the liquid while jetting to optimal jetting performance such as drop forming and less or no satellite forming by having smaller pinch-off-times and/or tail length of jetted liquid. In a preferred embodiment the jetting viscosity is from 20 mPa·s to 3,000 mPa·s and in a more preferred embodiment the jetting viscosity is from 25 mPa·s to 1,000 mPa·s.

The present invention overcomes in particular the problem of spray and elongated tail of the jetted liquid without introducing a reduction in print speed or fine ink channel architecture optimizations. In mathematical terms the distances (D,d) in the preferred embodiment meet the following equation:

$$D > d \times 1.2$$

In a preferred embodiment the maximum distance (D) from the outer edge ($O_E$) to the centre (c) of the minimum covering circle (C) is greater than the minimum distance (d) from the outer edge ($O_E$) to the centre (c) of the minimum covering circle (C) times the square root of three; and in a more preferred embodiment the maximum distance (D) from the outer edge ($O_E$) to the centre (c) of the minimum covering circle (C) is greater than the minimum distance (d) from the outer edge ($O_E$) to the centre (c) from the minimum covering circle (C) times the square root of four; and in the most preferred embodiment the maximum distance (D) from the outer edge ($O_E$) to the centre (c) of the minimum covering circle (C) is greater than the minimum distance (d) from the outer edge ($O_E$) to the centre (c) of the minimum covering circle (C) times the square root of five.

In a preferred embodiment the maximum distance (D) from the outer edge ($O_E$) to the centre (c) of the minimum covering circle (C) is smaller than the minimum distance (d) from the outer edge ($O_E$) to the centre (c) of the minimum covering circle (C) times 150; and in a more preferred embodiment the maximum distance (D) from the outer edge ($O_E$) to the centre (c) of the minimum covering circle (C) is smaller than the minimum distance (d) from the outer edge ($O_E$) to the centre (c) of the minimum covering circle (C) times 100; and in a most preferred embodiment the maximum distance (D) from the outer edge ($O_E$) to the centre (c) of the minimum covering circle (C) is smaller than the minimum distance (d) from the outer edge ($O_E$) to the centre (c) of the minimum covering circle (C) times 50;

In a preferred embodiment the maximum distance (D) from the outer edge ($O_E$) to the centre (c) of the minimum covering circle (C) is between 5 μm and 0.50 mm. The area of the shape (S) of the nozzle is preferably between 50 μm and 1 $mm^2$.

It was found that symmetry of the shape is important to have a good jetting performance, the shape (S) comprises preferably a set of axes of symmetry through the centre (c) of the minimum covering circle (C), more preferably comprises one or more axes of symmetry through the centre (c) of the minimum covering circle (C) and most preferably comprises two or more axes of symmetry through the centre (c) of the minimum covering circle (C). The symmetry of the shape minimizes disturbing effects in the flow of the liquid which results in a good jetting performance To achieve symmetry, the shape (S) with the outer edge ($O_E$) is preferably similar to a shape defined by the formula:

$$r(\theta) = \left[\left|\frac{\cos\left(\frac{1}{4}m\theta\right)}{a}\right|^{n2} + \left|\frac{\sin\left(\frac{1}{4}m\theta\right)}{b}\right|^{n3}\right]^{-1/n1} \quad \text{Math. 2}$$

This formula is a generalization of the superellipse and was first proposed by Johan Gielis. Johan Gielis suggested that this formula, also called the superformula of Gielis, can be used to describe many complex shapes and curves that are found in nature wherein symmetry is evident. The formula was further popularized by Piet Hein, a Danish mathematician.

Further advantages and preferred embodiments of the present invention will become apparent from the following description.

DETAILED DESCRIPTION OF THE PREFERRED EMBODIMENTS

Figure 1:
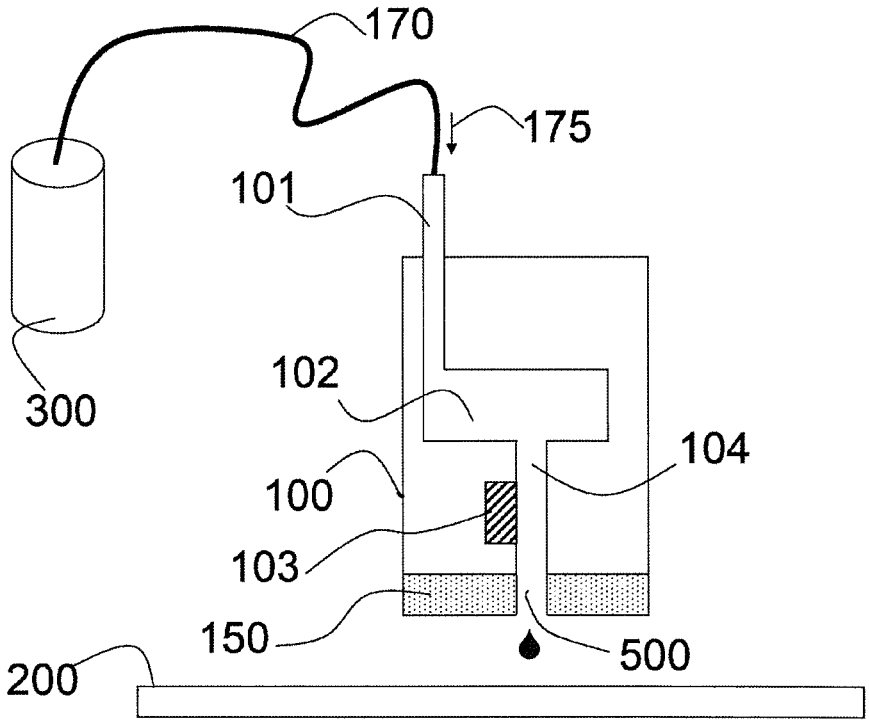
FIG. 1 illustrates a sectional of a printhead (100) which jets a liquid. The liquid is transported via a tube (170) from an external liquid feeding unit (300) in the flow direction (175) to a master inlet (101) of the printhead. The liquid is collected in a manifold (102) from where the liquid channel (104) is filled. By the droplet forming means (103) the liquid in the liquid channel (104) is jetted through the nozzle (500) which is comprised in the nozzle plate (150) of the printhead. The liquid is jetted on a receiver (200).
Figure 2:
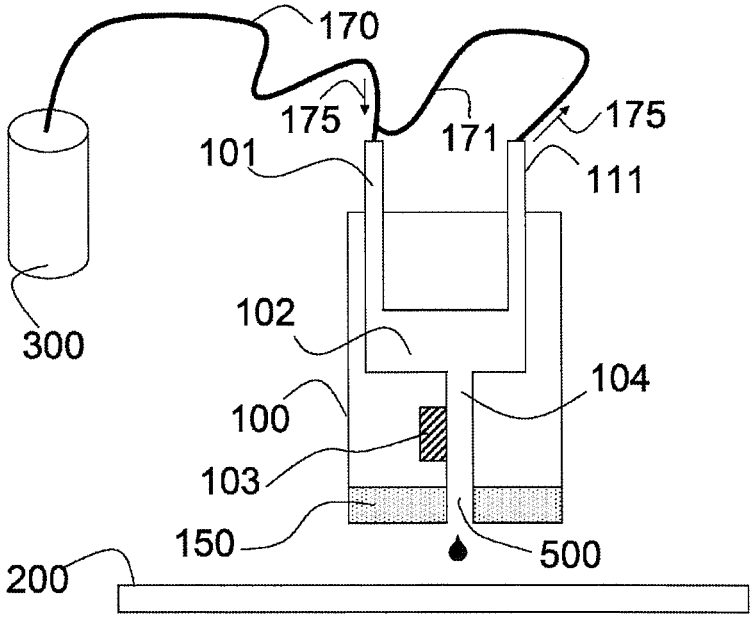
FIG. 2 illustrates a sectional of a printhead (100) wherein the liquid is recirculated. The liquid is transported via a tube (170) from an external liquid feeding unit (300) in the flow direction (175) to a master inlet (101) of the printhead. The liquid is collected in a manifold (102) from where the liquid channel (104) is filled. By the droplet forming means (103) the liquid in the liquid channel (104) is jetted through the nozzle (500) in the nozzle plate (150) of the printhead. The liquid is jetted on a receiver (200). The liquid is recirculated via the manifold (102) to a master outlet (111) in the flow direction (175) via a tube (171) wherein the liquid is transported back to the master inlet (101).
Figure 3:
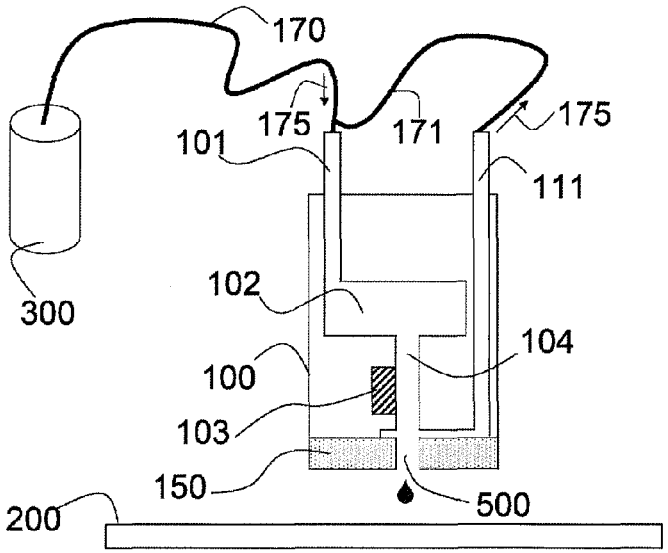
FIG. 3 illustrates a sectional of a printhead (100) wherein the liquid is recirculated. The liquid is transported via a tube (170) from an external liquid feeding unit (300) in the flow direction (175) to a master inlet (101) of the printhead. The liquid is collected in a manifold (102) from where the liquid channel (104) is filled. By the droplet forming means (103) the liquid in the liquid channel (104) is jetted through the nozzle (500) in the nozzle plate (150) of the printhead. The liquid is jetted on a receiver (200). The liquid is recirculated via a channel between the nozzle plate (150) and the liquid channel to a master outlet (111) in the flow direction (175) via a tube (171) wherein the liquid is transported back to the master inlet (101).
Figure 4:
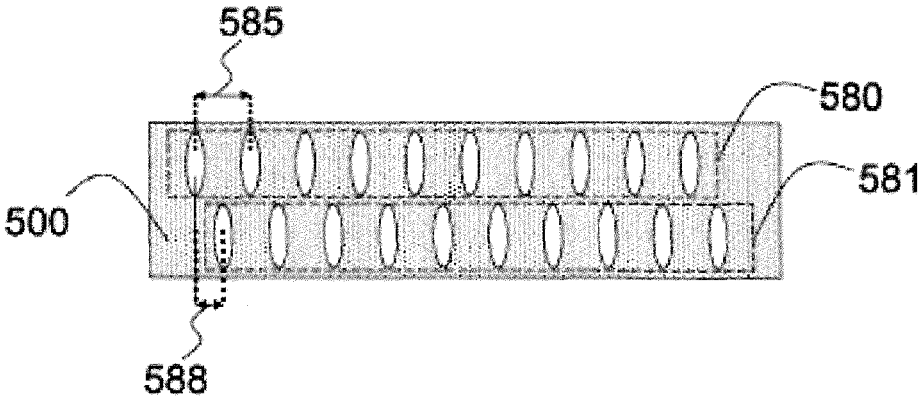
FIG. 4 illustrates the front side of a nozzle plate (200) in a printhead wherein 2 nozzle rows (580, 581) are comprised. Each nozzle row (580, 581) comprises 10 elliptical nozzles (500). The arrow (585) illustrates the nozzle spacing distance of a nozzle row (580). The arrow (588) illustrates the native print resolution of the printhead.
Figure 5:
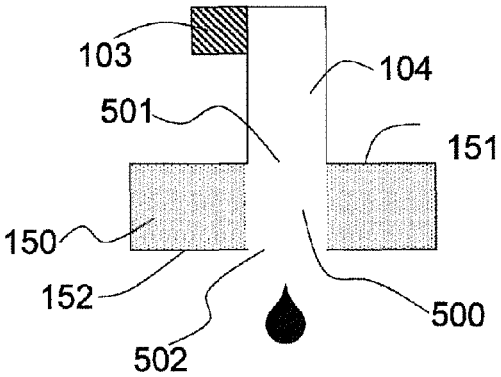
FIG. 5 illustrates a part in a sectional of a printhead with a nozzle plate (150) and a nozzle (500). By the droplet forming means (103) the liquid is jetted from the liquid channel (104) through the nozzle (500). The nozzle (500) has an entrance (501) and an exit (502). The back side of the nozzle plate (151) comprises the entrance (501) of the nozzle and the front side of the nozzle plate (152) comprises the exit (502) of the nozzle.
Figure 6:
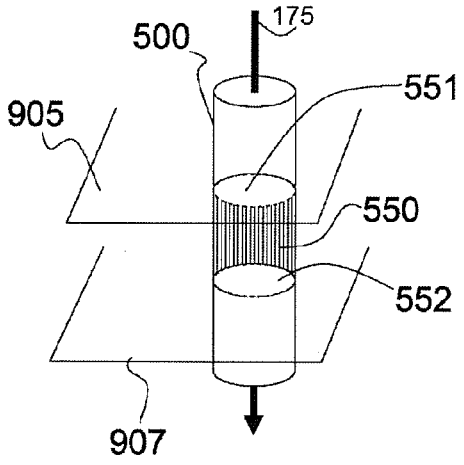
FIG. 6 illustrates a nozzle (500) wherein the arrow (175) illustrates the liquid flow in the nozzle (500). The nozzle (500) is intersected by two planes (905, 907) parallel to the nozzle plate (150), which is not visible, to have a sub-nozzle (550) of a nozzle. The sub-nozzle (550) has an inlet (551) and an outlet (552).
Figure 7:
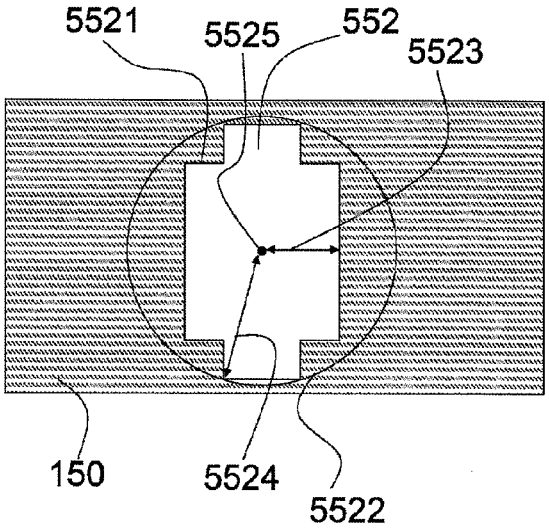
FIG. 7 illustrates a section of a sub-nozzle (550) in a nozzle plate (150). The shape (552) of the section of the sub-nozzle (550) has an outer edge ($O_E$) (5521) with a minimum covering circle (C) (5522). The arrow (5523) indicates the minimum distance from the outer edge ($O_E$) (5521) to the centre (5525) of the minimum covering circle (C) (5522). The arrow (5524) indicates the maximum distance from the outer edge ($O_E$) (5521) to the centre (5525) of the minimum covering circle (C) (5522).

In a preferred embodiment of the present invention, the method comprises a step of recirculating the high viscosity liquid through the piezoelectric printhead. The advantage to recirculate the high viscosity liquids in the piezoelectric printhead is that the liquid is in motion so less inertia is involved resulting in a better jettability of the high viscosity liquid.

The liquid is in a preferred embodiment an UV curable inkjet ink, a water based pigment ink or a water based resin inkjet ink, more preferably a solventless UV curable inkjet ink. A solventless UV curable inkjet ink requires less printer maintenance versus a liquid such as a solvent inkjet ink. Generally also a wider range of ink receivers can be addressed by an UV curable inkjet ink. If the liquid is an UV curable inkjet ink, the high viscosity jetting method preferably comprises a step of solidifying the jetted liquid on the receiver (200) by a UV radiation means.

In a preferred embodiment, an axis of symmetry from the set of axes of symmetry is parallel or perpendicular to the direction of the nozzle row. In an inkjet printing system the direction of the nozzle row is mostly parallel to the print direction, such as in a wide-format inkjet printer. It was surprisingly found that the axis of symmetry of this preferred embodiment influences the drop placement in the print direction in the advantage of better print quality. A possible reason is that the axes of symmetry parallel or perpendicular to the direction of the nozzle row influences favourable the dot accuracy in slow scan direction or fast scan direction of the inkjet printer which results in a better print quality.

There are 3 main different technologies of printheads are also called together drop-on-demand inkjet printheads meaning that a drop of ink is only produced when it is needed: valvejet printhead, a piezoelectric printhead or a thermal printhead.

Recirculation of a high viscosity liquid in a piezoelectric printhead, also called a through-flow piezoelectric printhead, avoids sedimentations, for example of pigment particles, in the piezoelectric printhead (e.g. in the liquid channels or manifolds (102)). Sedimentation may cause obstructions in the ink flow thereby negatively influencing the jetting performances. The recirculation of a liquid results also in less inertia of the liquid. In a more preferred embodiment the high viscosity jetting method makes use of a through-flow printhead such as a through-flow piezoelectric printhead, wherein the high viscosity liquid is recirculated in a continuous flow through a liquid transport channel where the pressure to the liquid is applied by a droplet forming means and wherein the liquid transport channel is in contact with the nozzle plate (FIG. 17, FIG. 18, FIG. 19 and FIG. 20). In a most preferred embodiment the droplet forming means applies a pressure in the same direction as the jetting directions towards the receiver (200) to activate a straight flow of pressurized liquid to enter the nozzle that corresponds to the droplet forming means (FIG. 17, FIG. 18, FIG. 19 and FIG. 20).

Printhead

A printhead is a means for jetting a liquid on a receiver (200) through a nozzle (500). The nozzle (500) may be comprised in a nozzle plate (150) which is attached to the printhead. A set of liquid channels, comprised in the printhead, corresponds to a nozzle (500) of the printhead which means that the liquid in the set of liquid channels can leave the corresponding nozzle (500) in the jetting method. The liquid is preferably an ink, more preferably an UV curable inkjet ink or water based inkjet ink, such as a water based resin inkjet ink. The liquid used to jet by a printhead is also called a jettable liquid. A high viscosity jetting method with UV curable inkjet ink is called a high viscosity UV curable jetting method. A high viscosity jetting method with water based inkjet ink is called a high viscosity water base jetting method.

The high viscosity jetting method of the preferred embodiment may be performed by an inkjet printing system. The way to incorporate printheads into an inkjet printing system is well-known to the skilled person.

A printhead may be any type of printhead such as a valvejet printhead, piezoelectric printhead, thermal printhead, a continuous printhead type, electrostatic drop on demand printhead type or acoustic drop on demand printhead type or a page-wide printhead array, also called a page-wide inkjet array.

A printhead comprises a set of master inlets (101) to provide the printhead with a liquid from a set of external liquid feeding units (300). Preferably the printhead comprises a set of master outlets (111) to perform a recirculation of the liquid through the printhead. The recirculation may be done before the droplet forming means but it is more preferred that the recirculation is done in the printhead itself, so called through-flow printheads. The continuous flow of the liquid in a through-flow printheads removes air bubbles and agglomerated particles from the liquid channels of the printhead, thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver (200) wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle (500) are replenished via one or more master inlets of the set of master inlets.

The amount of master outlets in the set of master outlets in a through-flow printhead is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the printhead wherein the mixing means is attached to the set of master inlets and the set of liquid channels. The mixing means may comprise a stirring device in a liquid container, such as a manifold (102) in the printhead, wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means (103), through the nozzle (500) that corresponds to the liquid channels. The droplet forming means (103) are comprised in the printhead. The droplet forming means (103) are activating the liquid channels to move the liquid out the printhead through the nozzle (500) that corresponds to the liquid channels.

The amount of liquid channels in the set of liquid channels that corresponds to a nozzle (500) is preferably from 1 to 12, more preferably from 1 to 6 and most preferably from 1 to 4 liquid channels.

The printhead is suitable for jetting a liquid having a jetting viscosity of 20 mPa·s to 3000 mPa·s. A preferred printhead is suitable for jetting a liquid having a jetting viscosity of 20 mPa·s to 200 mPa·s and a more preferred printhead is suitable for jetting a liquid having a jetting viscosity of 30 mPa·s to 150 mPa·s.

The maximum drop size in a print head is preferably lower than 50 pL, more preferably lower than 30 pL and most preferably lower than 15 pL.

Piezoelectric Printheads

Another preferred printhead for the high viscosity jetting method of the preferred embodiment is a piezoelectric printhead. Piezoelectric printhead, also called piezoelectric inkjet printhead, is based on the movement of a piezoelectric ceramic transducer, comprised in the printhead, when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means (103) of a piezoelectric printhead controls a set of piezoelectric ceramic transducers to apply a voltage to change the shape of a piezoelectric ceramic transducer. The droplet forming means (103) may be a squeeze mode actuator, a bend mode actuator, a push mode actuator or a shear mode actuator or another type of piezoelectric actuator.

Suitable commercial piezoelectric printheads are TOSHIBA TEC™ CK1 and CK1L from TOSHIBA TEC™ (https://www.toshibatec.co.jp/en/products/industrial/inkjet/prod ucts/cf1/) and XAAR™ 1002 and XAAR™ 001 from XAAR™ (http://www.xaar.com/en/products/xaar-1002).

A liquid channel in a piezoelectric printhead is also called a pressure chamber.

Between a liquid channel and a master inlet of the piezoelectric printheads, there is a manifold (102) connected to store the liquid to supply to the set of liquid channels.

The piezoelectric printhead is preferably a through-flow piezoelectric printhead. In a preferred embodiment the recirculation of the liquid in a through-flow piezoelectric printhead flows between a set of liquid channels and the inlet of the nozzle wherein the set of liquid channels corresponds to the nozzle (500).

In a preferred embodiment in a piezoelectric printhead the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes. The maximum drop size in a piezoelectric print head is preferably lower than 50 pL, more preferably lower than 30 pL and most preferably lower than 15 pL.

In a preferred embodiment the piezoelectric printhead has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric printhead has a native print resolution from 25 DPI to 2400 DPI, in a more preferred embodiment the piezoelectric printhead has a native print resolution from 50 DPI to 2400 DPI and in a most preferred embodiment the piezoelectric printhead has a native print resolution from 150 DPI to 3600 DPI.

In a preferred embodiment with the piezoelectric printhead the jetting viscosity is from 20 mPa·s to 200 mPa·s more preferably from 25 mPa·s to 100 mPa·s and most preferably from 30 mPa·s to 70 mPa·s.

In a preferred embodiment with the piezoelectric printhead the jetting temperature is from 10° C. to 100° C. more preferably from 20° C. to 60° C. and most preferably from 30° C. to 50° C.

The nozzle spacing distance of the nozzle row in a piezoelectric printhead is preferably from 10 μm to 200 μm; more preferably from 10 μm to 85 μm; and most preferably from 10 μm to 45 μm.

Inkjet Printing System.

The high viscosity jetting method is preferably performed by an inkjet printing system. The way to incorporate printheads into an inkjet printing system is well-known to the skilled person. More information about inkjet printing systems is disclosed in STEPHEN F. POND. Inkjet technology and Product development strategies. United States of America: Torrey Pines Research, 2000, ISBN 0970086008.

An inkjet printing system, such as an inkjet printer, is a marking device that is using a printhead or a printhead assembly with one or more printheads, which jets ink on a receiver (200). A pattern that is marked by jetting of the inkjet printing system on a receiver (200) is preferably an image. The pattern may be achromatic or chromatic colour.

A preferred embodiment of the inkjet printing system is that the inkjet printing system is an inkjet printer and more preferably a wide-format inkjet printer. Wide-format inkjet printers are generally accepted to be any inkjet printer with a print width over 17 inch. Digital printers with a print width over the 100 inch are generally called super-wide printers or grand format printers. Wide-format printers are mostly used to print banners, posters, textiles and general signage and in some cases may be more economical than short-run methods such as screen printing. Wide format printers generally use a roll of substrate rather than individual sheets of substrate but today also wide format printers exist with a printing table whereon substrate is loaded.

A printing table in the inkjet printing system may move under a printhead or a gantry may move a printhead over the printing table. These so called flat-table digital printers most often are used for the printing of planar substrates, ridged substrates and sheets of flexible substrates. They may incorporate IR-dryers or UV-dryers to prevent prints from sticking to each other as they are produced. An example of a wide-format printer and more specific a flat-table digital printer is disclosed in EP1881903 B (AGFA GRAPHICS NV).

The high viscosity jetting method may be comprised in a single pass printing method. In a single pass printing method the inkjet printheads usually remain stationary and the substrate surface is transported once under the one or more inkjet printheads. In a single pass printing method the method may be performed by using page wide inkjet printheads or multiple staggered inkjet printheads which cover the entire width of the receiver (200). An example of a single pass printing method is disclosed in EP 2633998 A (AGFA GRAPHICS NV).

The inkjet printing system may mark a broad range of substrates such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, transparency foils, adhesive PVC sheets and others.

Preferably the inkjet printing system comprises one or more printheads jetting UV curable ink to mark a substrate and a UV source, as dryer system, to cure the inks after marking. Spreading of a UV curable inkjet ink on a substrate may be controlled by a partial curing or "pin curing" treatment wherein the ink droplet is "pinned", i.e. immobilized whereafter no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing system that performs the preferred embodiment may be used to create a structure through a sequential layering process by jetting sequential layers, also called additive manufacturing or 3D inkjet printing. So the high viscosity jetting method of the preferred embodiment is preferably comprised in a 3D inkjet printing method. The objects that may be manufactured additively by the preferred embodiment of the inkjet printing system can be used anywhere throughout the product life cycle, from pre-production (i.e. rapid prototyping) to full-scale production (i.e. rapid manufacturing), in addition to tooling applications and post-production customization. Preferably the object jetted in additive layers by the inkjet printing system is a flexographic printing plate. An example of such a flexographic printing plate manufactured by an inkjet printing system is disclosed in EP2465678 B (AGFA GRAPHICS NV).

The inkjet printing system that performs the preferred embodiment may be used to create relief, such as topographic structures on an object, by jetting a sequential set of layers, e.g. for manufacturing an embossing plate. An example of such relief printing is disclosed in US 20100221504 (JOERG BAUER). So the high viscosity jetting method of the preferred embodiment is preferably comprised in a relief inkjet printing method. Jetting with liquids at a jetting viscosity of at least 20 mPa·s allows to add high molecular weight chemical compounds for a better result in relief inkjet printing, such as the harness of the relief for a embossing plate or flexographic plate.

The inkjet printing system of the preferred embodiment may be used to create printing plates used for computer-to-plate (CTP) systems in which a proprietary liquid is jetted onto a metal base to create an imaged plate from the digital record. So the high viscosity jetting method of the preferred embodiment is preferably comprised in an inkjet computer-to-plate manufacturing method. These plates require no processing or post-baking and can be used immediately after the ink-jet imaging is complete. Another advantage is that platesetters with an inkjet printing system is less expensive than laser or thermal equipment normally used in computer-to-plate (CTP) systems. Preferably the object that may be jetted by the preferred embodiment of the inkjet printing system is a lithographic printing plate. An example of such a lithographic printing plate manufactured by an inkjet printing system is disclosed EP1179422 B (AGFA GRAPHICS NV). Jetting with liquids at a jetting viscosity of at least 20 mPa·s allows to add high molecular weight chemical compounds for a better result in inkjet computer-to-plate method such as the offset ink accepting capability.

Preferably the inkjet printing system is a textile inkjet printing system, performing a textile inkjet printing method. In industrial textile inkjet printing systems, printing on multiple textiles simultaneously is an advantage for producing printed textiles in an economical manner. So the high viscosity jetting method of the preferred embodiment is preferably comprised in a textile printing method by using a printhead. Jetting with liquids at a jetting viscosity of at least 20 mPa·s allows to add high molecular weight chemical compounds for a better result in textile inkjet printing method such as flexibility of the jetted liquid after drying on a textile.

Preferably the inkjet printing system is a ceramic inkjet printing system, performing a ceramic inkjet printing method. In ceramic inkjet printing systems printing on multiple ceramics simultaneously is an advantage for producing printed ceramics in an economical manner. So the high viscosity jetting method of the preferred embodiment is preferably comprised in a printing method on ceramics by using a printhead. Jetting with liquids at a jetting viscosity of at least 20 mPa·s allows to add high molecular weight chemical compounds, such as sub-micron glass particles and inorganic pigments for a better result in ceramic inkjet printing method.

Preferably the inkjet printing system is a glass inkjet printing system, performing a glass inkjet printing method. In glass inkjet printing systems printing on multiple glasses simultaneous is an advantage for producing printed glasses in an economical manner. So the high viscosity jetting method of the preferred embodiment is preferably comprised in a printing method on glass by using a printhead.

Preferably the inkjet printing system is a decoration inkjet printing system, performing a decoration inkjet printing method, to create digital printed wallpaper, laminate, digital printed objects such as flat workpieces, bottles, butter boats or crowns of bottles.

Preferably the inkjet printing system is comprised in an electronic circuit manufacturing system and the high viscosity jetting method of the preferred embodiment is comprised in an electronic circuit manufacturing method wherein the liquid is a inkjet liquid with conductive particles, often generally called conductive inkjet liquid.

The preferred embodiment is preferably performed by an industrial inkjet printing system such as a textile inkjet printing system, ceramic inkjet printing system, glass inkjet printing system, decoration inkjet printing system.

The preferred embodiment of the high viscosity jetting method is preferably comprised in an industrial inkjet printing method such as a textile inkjet printing method, a ceramic inkjet printing method, a glass inkjet printing method, a decoration inkjet printing method.

Nozzle Plate

The nozzle plate (150) is a flat layer at the outside of a piezoelectric printhead and fixed to the piezoelectric printhead. The nozzle plate (150) is the layer where through a liquid is jetted on a receiver (200) via a nozzle (500) in the nozzle plate (150). It refers to the part of the piezoelectric printhead which the liquid lastly passes through, before it is discharged from the piezoelectric printhead. A nozzle plate (150) comprises a set of nozzles where through the liquid is jetted on a receiver (200). The number of nozzles in the set of nozzles may be one or more than one nozzle (500); and is preferably from 1 to 12000 nozzles, more preferably 1 to 6000 nozzles and most preferably 1 to 3000 nozzles.

If the number of nozzles in the set of nozzles is more than one, a part of the set of nozzles may be placed in a row which is called a nozzle row. The nozzle spacing distance of a nozzle row is the smallest distance along the nozzle row direction between the centres of the nozzles in a nozzle row which is preferably from 10 μm to 200 μm. The native print resolution of a piezoelectric printhead is the smallest distance along all nozzles along the nozzle row direction between the centres of all the nozzles in the piezoelectric printhead.

Preferably the nozzle plate (150) comprises a plurality of nozzle rows wherein each nozzle row has the same nozzle spacing distance and the nozzle rows are parallel to each other and wherein more preferably the smallest shift along the nozzle row direction between the nozzles of one nozzle row and the nozzles of the following nozzle row is the nozzle spacing distance of the nozzle rows divided by an integer more than one and wherein most preferably the smallest shift along the nozzle row direction between the nozzles of one nozzle row and the nozzles of the following nozzle row is the nozzle spacing distance of the nozzle rows divided by two.

A nozzle plate (150) may comprise a plurality of nozzle rows wherein a first nozzle row has a different nozzle spacing distance than a second nozzle row.

In another preferred embodiment the nozzle plate (150) comprises a plurality of nozzle rows wherein each nozzle row has the same nozzle spacing distance and the nozzle rows are parallel to each other and wherein a first liquid is jetted through the nozzle plate (150) via the nozzles of a first nozzle row and a second liquid is jetted through the nozzle plate (150) via the nozzles of a second nozzle row.

The nozzle plate (150) is preferably parallel to the receiver (200) whereon the liquid is jetted to have a straight, perpendicular to the receiver, jetting performance.

The nozzle plate (150) has preferably a thickness from 10 μm to 100 μm. A nozzle plate (150) needs to have some stiffness but the nozzle becomes longer with a thicker nozzle plate (150). The shear resistance of a longer nozzle becomes higher which requires a higher pressure in the liquid channels to give sufficient drop speed.

The manufacturing of a nozzle plate (150) with its set of nozzles may be performed by laser hole drilling or more preferably by MEMS technology or NEMS technology. Other methods of manufacturing a nozzle plate (150) may be in mould techniques or punching techniques. MEMS and NEMS technology is preferred as it allows to manufacture piezoelectric printheads more easily with nozzle geometries as in the invention compared to laser hole drilling.

Laser hole drilling to manufacture the nozzles in a nozzle plate (150) may be performed one nozzle (500) at a time with high repetition rate or even may be processed parallel to manufacture multiple nozzles per step and repeat using high energy lasers. An example of laser drilled nozzles in a nozzle plate (150) is disclosed in U.S. Pat. No. 8,240,819 (SEKI MASASHI, TOSHIBA TEC KK).

Micro-Electro-Mechanical Systems, or MEMS, is a technology that is defined as miniaturized mechanical and electro-mechanical elements (i.e., devices and structures) that are made using the techniques of microfabrication. The critical physical dimensions of MEMS devices can vary from well below one micron on the lower end of the dimensional spectrum, all the way to several millimeters. Likewise, the types of MEMS devices can vary from relatively simple structures having no moving elements, to extremely complex electromechanical systems with multiple moving elements under the control of integrated microelectronics. The one main criterion of MEMS is that there are at least some elements having some sort of mechanical functionality whether or not these elements can move. MEMS are sometimes also called "microsystems technology or micromachined devices.

Nano-Electro-Mechanical Systems, or NEMS, is a class of devices integrating electrical and mechanical functionality on the nanoscale. NEMS form the logical next miniaturization step from so-called Micro-Electro-Mechanical Systems, or MEMS devices. NEMS typically integrate transistor-like nanoelectronics with mechanical actuators, pumps, or motors, and may thereby form physical, biological, and chemical sensors. The name derives from typical device dimensions in the nanometer range, leading to low mass, high mechanical resonance frequencies, potentially large quantum mechanical effects such as zero point motion, and a high surface-to-volume ratio useful for surface-based sensing mechanisms.

A preferred method of MEMS technology for an nozzle plate (150) in a printhead is disclosed in US 20120062653 (SILVERBROOK RESEARCH PTY LTD).

MEMS and NEMS technology facilitates the possibilities to manufacture specific nozzle (500) sections in a nozzle (500) as in the present invention.

The backside of a nozzle plate in a piezoelectric printhead is the flat side of the nozzle plate at the entrance of a nozzle and which faces the set of liquid channels of the nozzle.

The front side of a nozzle plate in a piezoelectric printhead is the flat side of the nozzle plate at the exit of a nozzle which faces the receiver (200) of the jetted liquids.

In a preferred embodiment the outlet of the nozzle is surrounded by a non-wetting coating layer which is comprised at the front side of the nozzle plate, also called the outer side of the nozzle plate.

In a preferred embodiment the front side of the nozzle plate comprises a layer which is called a non-wetting coating. The liquid from the piezoelectric printhead has to be ejected in a stable manner in the form of a complete droplet, in order to obtain a high printing quality. That is why a non-wetting treatment, such as attaching a non-wetting coating to the front side of the nozzle plate, may be performed on the front side of the nozzle plate and preferably around the outlet and/or the surface of the nozzle, so that the meniscus of the droplet may be formed appropriately. Without a non-wetting treatment, wetting may occur, in which the liquid douses the surface of the outlet of the nozzle as it is ejected from the nozzle (500), so that the liquid dousing the surface of the outlet of the nozzle and the liquid being ejected form a lump together, causing the liquid to be ejected in a flowing manner without achieving a complete droplet. This may result in poor printing quality, and the meniscus formed subsequently after the ejection of liquid may also become unstable. Therefore, in order to ensure a high level of reliability in a piezoelectric printhead, there is a need to perform a non-wetting treatment around the outlet of the nozzle and/or on the surface of the nozzles.

Nozzle (500)

A nozzle (500) is an orifice in a nozzle plate (150) of a piezoelectric printhead through which a liquid is jetted on a receiver (200).

The length of a nozzle is the distance between the entrance of the nozzle and the exit of the nozzle. If the nozzle (500) is comprised in a nozzle plate (150), the length of the nozzle is defined by the thickness of the nozzle plate.

The flow path of the liquid is from the entrance of the nozzle to the exit of the nozzle. Typically the distance between the receiver (200) and the exit of the nozzle, also called the printhead gap, is between 100 μm and 10000 μm.

A section of a nozzle is the intersection of the nozzle and a plane parallel to the plane wherein the outlet of the nozzle is located.

A sub-nozzle (550) of a nozzle is the part of the nozzle between two different sections of the nozzle wherein the section nearest to the entrance of the nozzle is called the inlet of the sub-nozzle (550) and the section nearest to the exit of the nozzle is called the outlet of the sub-nozzle (550).

The inlet of a nozzle is the intersection of the nozzle and the plane wherein the backside of the nozzle plate is comprised so the inlet of the nozzle is facing a set of liquid channels. The inlet of the nozzle is thus a section of the nozzle.

The outlet of a nozzle is the intersection of the nozzle and the plane wherein the front side of the nozzle plate is comprised so the outlet of the nozzle is facing the receiver (200) of the jetted liquid. The outlet of the nozzle is thus a section of the nozzle.

The shape of the inlet of a sub-nozzle (550) in the preferred embodiment is preferably similar with the shape of the outlet of a sub-nozzle (550). To avoid a high resistance in the nozzle (500) for the jettable liquid such similarity is preferred for a better jetting performance. Two shapes are similar if one can be transformed into the other by a uniform scaling, together with a sequence of rotation, translations and/or reflections. Two edges, such as outer edges of a shape, are similar if one can be transformed into the other by a uniform scaling, together with a sequence of rotation, translations and/or reflections.

In a preferred embodiment wherein the nozzle (500) is comprised in a nozzle plate, the axis between the centres of the minimum covering circle (C) from the outer edges from the inlet and outlet of sub-nozzle (550) is perpendicular to the nozzle plate (150). It was found that symmetries in a sub-nozzle (550) give better jetting performance.

The maximum diameter of the minimum covering circle (C) from the outlet of sub-nozzle (550) is preferably from 10 μm to 100 μm, more preferably from 15 μm to 45 μm, and most preferably from 20 μm to 40 μm.

The minimum distance (d) from the outer edge ($O_E$) to the centre (c) of the minimum covering circle (C) is preferably from 0.001 μm to 75 μm.

Two-Dimensional Shape

A two-dimensional shape is the form of a two-dimensional object which has an external boundary which is defined by its outer edge ($O_E$). A two-dimensional shape is also called a shape if it is clear that the two-dimensional shape lies in a plane.

Two shapes are similar if one can be transformed into the other by a uniform scaling, together with a sequence of rotations, translations and/or reflections.

In a preferred embodiment the outer edge ($O_E$) from the shape in the preferred embodiment comprises a set of axes of symmetry. Preferably one of the set of axes of symmetry is parallel or perpendicular to the plane wherein the nozzle plate (150) lies. It is found that symmetry of a section in the nozzle (500) is a big advantage, for example with less disturbance in the liquid flow (175), for jetting performance which is the case when the outer edge ($O_E$) from the shape comprises a set of axes of symmetry. An axis of symmetry in a two-dimensional shape is also called a mirror line in the two-dimensional shape.

A minimum point on an edge, such as an outer edge ($O_E$), is a point on the edge wherein the distance from that point to the centre of the minimum covering circle (C) of the edge is the minimum distance in view from all points on the edge to the centre of the minimum covering circle (C) of the edge.

A maximum point on an edge, such as an outer edge ($O_E$), is a point on the edge wherein the distance from that point to the centre of the minimum covering circle (C) of the edge is the maximum distance in view from all points on the edge to the centre of the minimum covering circle (C) of the edge.

The amount of minimum points on the outer edge ($O_E$) is preferably from 1 to 12, more preferably from 1 to 6 and most preferably from 1 to 4 minimum points on the outer edge ($O_E$). The amount of minimum points on the outer edge ($O_E$) is preferable a multiplier of two with a minimum of two minimum points on the outer edge ($O_E$).

The amount of maximum points on the outer edge ($O_E$) is preferably from 1 to 12, more preferably from 1 to 6 and most preferably from 1 to 4 maximum points on the outer edge ($O_E$). The amount of maximum points on the outer edge ($O_E$) is preferable a multiplier of two with a minimum of two maximum points on the outer edge ($O_E$).

In a preferred embodiment the outer edge ($O_E$) of the shape is an ellipse wherein the transverse diameter is larger than the conjugate diameter of the ellipse. The transverse diameter is the largest distance between two points on the ellipse and the conjugate diameter is the smallest distance between two points on the ellipse.

In a preferred embodiment the outer edge ($O_E$) of the shape is a rectangle.

Figure 8:
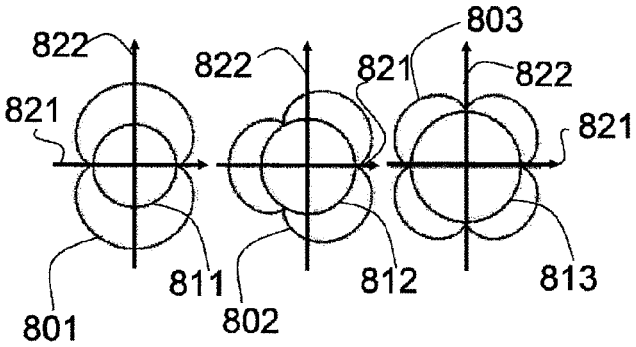
FIG. 8 illustrates 3 epicycloids (801, 802, 803) with an X-axes (821) and Y-axes (822). The 3 epicycloids (801, 802, 803) are slipping around on a fixed circle (811, 812, 813). The second epicycloid (802) is also called a nephroid.

In a preferred embodiment the outer edge ($O_E$) of the shape is an epicycloid with k cusps and where k is an integer number, more preferably the shape is an epicycloid with 1, 2, 3, 4 or five cusps. An epicycloid is a plane curve produced by tracing the path of a chosen point of a circle—called an epicycle—which rolls without slipping around a fixed circle (FIG. 8). If the smaller circle has radius r, and the larger circle has radius R=kr, then the parametric equations for the curve can be given by the following formula (I):

$$\begin{cases} x(\theta) = (r(k+1)\cos(\theta) - r\cos((k+1)\theta) \\ y(\theta) = r(k+1)\sin(\theta) - r\sin((k+1)\theta) \end{cases} \quad \text{Math. 3}$$

wherein k defines the amounts of cusps so k is a positive integer and k is more than zero). An epicycloid with one cusp is called a cardioid, one with two cusps is called a nephroid and one with five cusps is called a ranunculoid. It is found that symmetry of a section in the nozzle (500) is a big advantage for jetting performance which is the case in epicycloids. The symmetry of such epicycloids minimizes the disturbing effects in the liquid flow (175) which results in better dot forming. The outside boundary of an epiclyoid defines the shape of the epicycloid which in a preferred embodiment is similar to the shape (S) of the section of a nozzle ($N_S$) in the preferred embodiment.

In a more preferred embodiment the outer edge ($O_E$) from the shape is similar to a superellipse, defined by the following formula, defined in Cartesian coordinates (II):

$$\left|\frac{x}{a}\right|^r + \left|\frac{y}{b}\right|^r = 1 \quad \text{Math. 4}$$

Superellipses with a equal to b are also known as Lamé curves or Lamé ovals, and the case a=b with r=4 is sometimes known as the squircle. By analogy, the superellipse with a not equal to b and r=4 might be termed the rectellipse. It is found that symmetry of a section in the nozzle (500) is a big advantage for jetting performance which is the case in superellipses.

Figure 9:
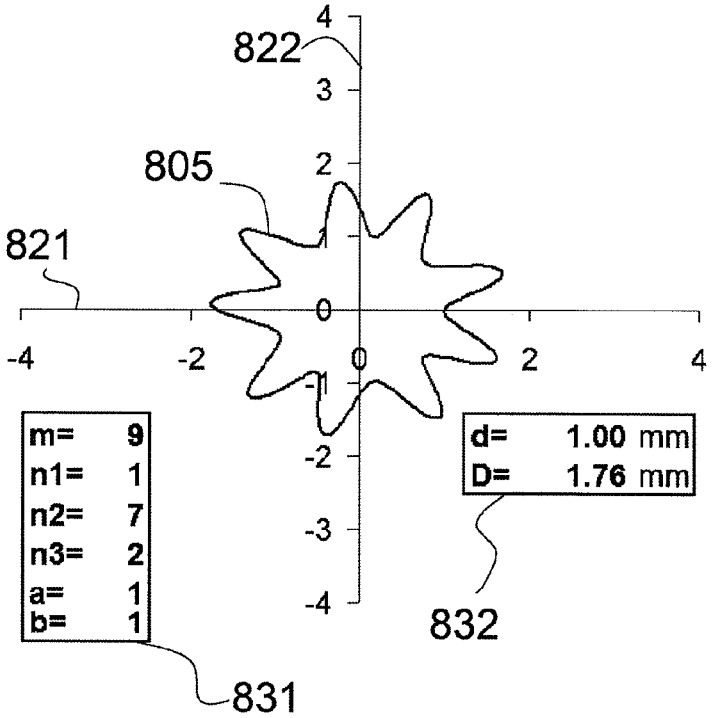
FIGS. 9 to 12 illustrate each a shape that is defined by the 'superformula' of Gielis wherein the parameters (m, n1, n2, n3, a, b) of the 'superformula' of Gielis can be read in the parameter box (831) and the minimum distance (d) between outer edge ($O_E$) of the shape and the centre and the maximum distance (D) between outer edge ($O_E$) of the shape and the centre can be read in the calculation box (832).
Figure 10:
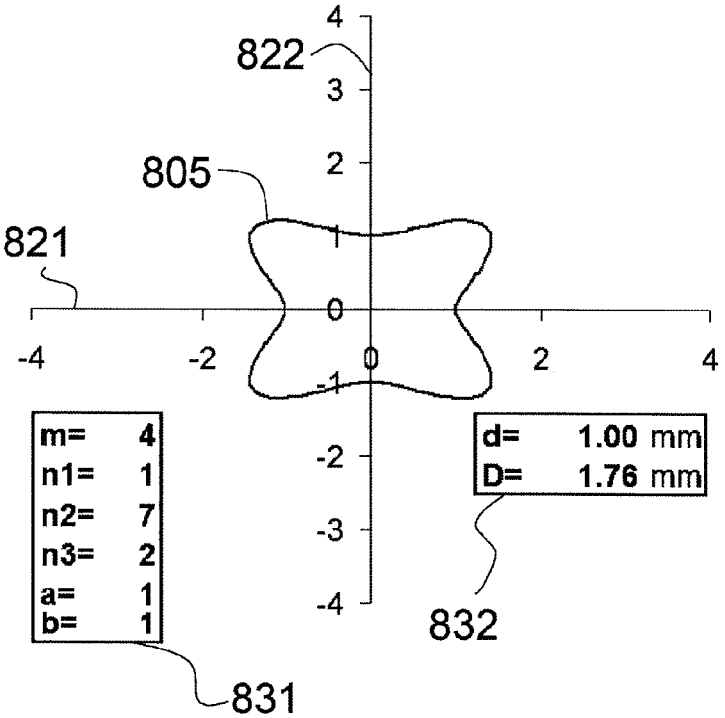
Figure 11:
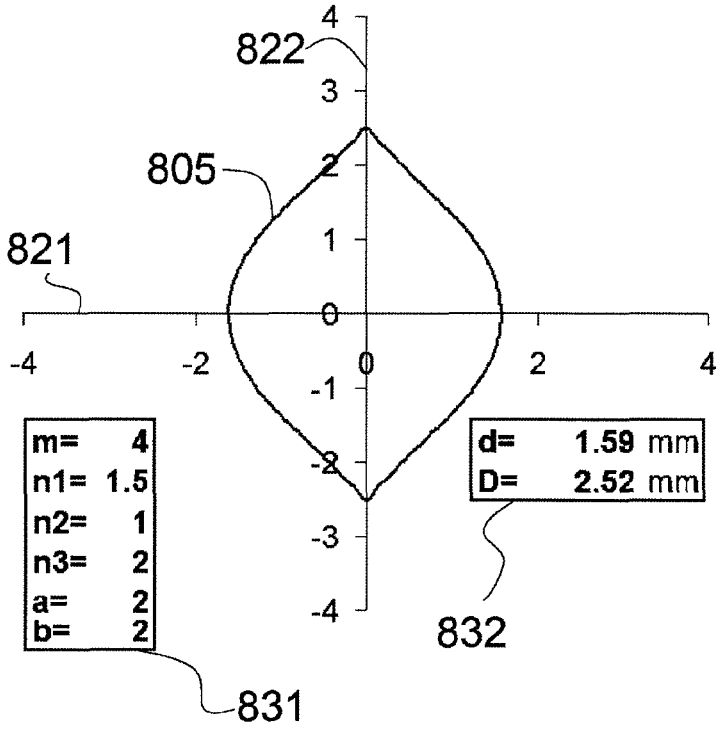
Figure 12:
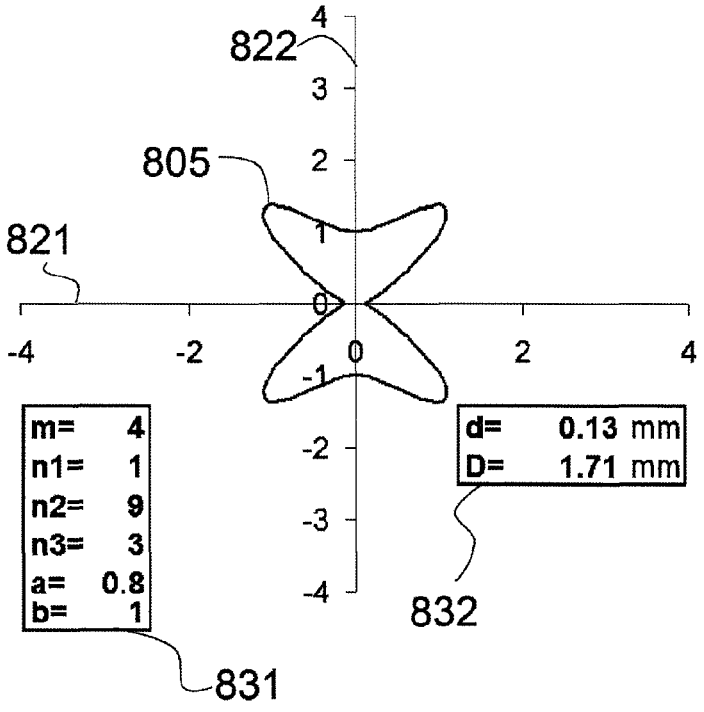

In a most preferred embodiment the outer edge ($O_E$) from the shape is similar to the generalisation of the superellipse, proposed by Johan Gielis, defined by the following formula, defined in polar coordinates (III):

$$r(\theta) = \left[\left|\frac{\cos\left(\frac{1}{4}m\theta\right)}{a}\right|^{n2} + \left|\frac{\sin\left(\frac{1}{4}m\theta\right)}{b}\right|^{n3}\right]^{-1/n1} \quad \text{Math. 5}$$

wherein the parameter m and the use of polar coordinates gives rise outer edges and/or inner edges with m-fold rotational symmetry. The formula is also called the 'superformula' (FIG. 9, FIG. 10. FIG. 11, FIG. 12). The outside boundary of a 'superformula' to define the shape from the 'superformula' which in a preferred embodiment is similar to the shape (S) of the section of a nozzle ($N_S$) in the embodiment. In a preferred embodiment r(θ) in the superformula is equal for θ=0 and θ=2 kn to get a closed curve which defines the shape which is similar to the outer edge ($O_E$) from the shape in the embodiment. The value k is a positive integer more than zero. The number n is a mathematical constant, the ratio of a circle's circumference to its diameter, approximately equal to 3.14159. More information about the 'superformula' of Johan Gielis is disclosed in U.S. Pat. No. 7,620,527 (JOHAN LEO ALFONS GIELIS).

It is found that symmetry of a section in the nozzle (500) is a big advantage for jetting performance which is the case in the 'superformula' of Johan Gielis. Symmetry in the shape results in minimized disturbing effects of the liquid flow (175).

In a preferred embodiment the outer edge ($O_E$) of the shape is a rounded rectangle, rectellipse, semicircle, a stadium, oval. A stadium is a two-dimensional geometric shape constructed of a rectangle with semicircles at a pair of opposite sides. More information about rectellipse is disclosed in Fernandez Guasti, M. "Analytic Geometry of Some Rectilinear Figures." Int. J. Educ. Sci. Technol. 23, 895-901, 1992. A semicircle is a one-dimensional locus of points that forms half of a circle.

In a preferred embodiment the outer edge ($O_E$) of the shape from a section of a nozzle ($N_S$) has a set of corners such as in a square or rectangle. It was surprisingly found that in this preferred embodiment, the jetting performance, for example by smaller pinch-off-times, was increased. Probably the liquid flow in the nozzle of this preferred embodiment is delayed in a corner of the set of corners so the supplying of the liquid to the centre of the nozzle is reduced and the tail length is smaller. The corner has preferably an internal angle (thus inside the outer edge ($O_E$) smaller than 160 degrees, more preferably smaller than 120 degrees.

Minimum Covering Circle

A covering circle describes a circle wherein all of a given set of points are contained in the interior of the circle or on the circle. The minimum covering circle (C) is the covering circle for a given set of points with the smallest radius.

Like any circle, a covering circle is defined by its centre in which the distance between the centre and each point on the circle is equal. The distance between the centre and a point on the circle is called the radius. A circle is a simple closed curve which divides the plane, wherein the circle is comprised, into two regions: an interior and an exterior.

Finding the minimum covering circle (C) of a given set of points is called minimum covering circle (C) problem, also called the smallest-circle problem.

More information how to solve the minimum covering circle (C) problem can be found in MEGIDDO, NIMROD. Linear-time algorithms for linear programming in R3 and related problems. *SIAM Journal on Computing*. 1983, vol. 12, no. 4, p. 759-776.

A simple randomized algorithm to solve the minimum covering circle (C) problem can be found in WELZL, EMO. Smallest enclosing disks (balls and ellipsoids). *New Results and New Trends in Computer Science* (H. Maurer, Ed.), *Lecture Notes in Computer Science* 555. 1991, p. 359-370.

The minimum covering circle (C) of the outer edge ($O_E$) of a shape is the minimum covering circle (C) from all points on this outer edge ($O_E$) from the shape. This means also that all points of the shape and in the shape are contained in the interior of minimum covering circle (C) or on the minimum covering circle (C).

From each point of the outer edge ($O_E$) of the shape, the distance between the point and the centre of the minimum covering circle (C) can be calculated and thus also the minimum and maximum distance from the outer edge ($O_E$) from the shape to the centre of the minimum covering circle (C) of the outer edge ($O_E$) of the shape can be determined.

Inkjet Ink

In a preferred embodiment, the liquid is an ink, such as an inkjet ink, and in a more preferred embodiment the inkjet ink is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment.

The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™.

In a preferred embodiment the liquid is an inkjet ink comprising metallic particles or comprising inorganic particles such as a white inkjet ink.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 $s^{-1}$ or with the HAAKE Rotovisco 1 Rheometer with sensor C60/1 Ti at a shear rate of 1000 $s^{-1}$ In a preferred embodiment the jetting viscosity is from 20 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the piezoelectric printhead while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

The present invention may comprise a viscosity control system because a high viscosity jetting method with at least 20 mPa·s asks for a high accurate viscosity control. So the piezoelectric printhead may comprise:

an ink fluid circuit supported substantially within said compact housing member, said ink fluid circuit comprising:

a recirculation tank enclosed within said piezoelectric printhead;

a recirculation pump enclosed within said piezoelectric printhead, said pump configured to substantially pulselessly draw ink from said recirculation tank and to substantially pulselessly impel ink within said circuit;

a heating assembly mounted to said piezoelectric printhead for heating ink impelled by said recirculation pump;

a sensor assembly comprising first and second pressure sensors and first and second viscosity sensors mounted to said piezoelectric printhead and configured to detect the pressure and temperature of: ink received from said heating assembly; and return ink received from one or more printheads;

and a control system housed within said piezoelectric printhead and configured to be responsive to said sensors and operable to adjust said recirculation pump speed and temperature of said heating assembly.

In one preferred embodiment of the invention, said recirculation tank is in fluid communication with an air pump operable for removing air from said recirculation tank.

In another preferred embodiment, said heating assembly comprises a conduit through which ink is conveyed, said conduit formed into a double-spiral and in thermal contact with one or more heating elements.

In another preferred embodiment, said ink fluid circuit further comprises a bypass line for conveying ink impelled by said recirculation pump into said recirculation tank in the event fluid pressure within said circuit increases beyond a threshold value.

In a further preferred embodiment, said control system is a computer-based processor having a memory configured with control logic for executing the steps of:

obtaining a measured differential pressure derived from said sensor assembly;

obtaining a measured temperature derived from said sensor assembly;

comparing said measured differential pressure to at least one pre-defined acceptable pressure and said measured temperature to at least one pre-defined acceptable temperature;

varying the speed of said recirculation pump in response to said comparison; and varying heat generated by said heating assembly in response to said comparison.

EXAMPLES

The nozzles in the examples have all a length of 70 μh. The contact angle inside the nozzles is 60 degrees for all examples and the contact angle of the front side of the nozzle plate is for all examples 110 degrees.

For Nozzle 1 the shape is a circle which is the current state of the art. For Nozzle 2 the shape is an ellipse, for Nozzle 3 the shape is a composition of two circles, for Nozzle 4 the shape is a circle with 4 protrusions, for Nozzle 5 the shape is a square. By comparing Nozzle 1, the current state of the art, with the Nozzle 2, Nozzle 3, Nozzle 4 and Nozzle 5, which meets the preferred embodiment of the invention, the pinch-off-time of the jetted liquid was determined for jettable liquids having a jetting viscosity of 10 mPa·s (Liquid 1), 20 mPa·s (Liquid 2), 30 mPa·s (Liquid 3), and 50 mPa·s (Liquid 4). Liquid 1 with a jetting viscosity of 10 mPa·s represents the current state of the art when used with Nozzle 1.

To distinguish the jetting performance such as minimal number of satellites, the pinch-off-time in μs was determined. The smaller the pinch-off-time of the jetted liquid, the better the jetting performance. Also in some comparisons the tail length in μm was determined. The smaller the tail length of the jetted liquid, the better the jetting performance such as minimal number of satellites.

Nozzle 1: The shape of all sections in the nozzle was a circle with a radius of 17.197 μm. The area of the shape was 929.12 $\mu m^2$ and the volume was 65038.4 $\mu m^3$. The maximum distance (D) from the outer edge ($O_E$) to the centre (c) of the minimum covering circle (C) was 17.197 μm and the minimum distance (d) from the outer edge ($O_E$) to the centre (c) from the minimum covering circle (C) was 17.197 μm so the maximum distance D was not greater than the minimum distance (d) times 1.2.

Nozzle 2: The shape of all sections in the nozzle was an ellipse with as conjugate diameter 2×12.16 μm and with as transverse diameter 2×24.321 μm. The area of the shape was 929.12 $\mu m^2$ and the volume was 65202.83 $\mu m^3$. The maximum distance (D) from the outer edge ($O_E$) to the centre (c) of the minimum covering circle (C) was 24.321 μm and the minimum distance (d) from the outer edge ($O_E$) to the centre (c) from the minimum covering circle (C) was 12.16 μm so the maximum distance D was greater than the minimum distance (d) times square root of two. Nozzle 21: The shape of all sections in the nozzle was an ellipse with a conjugate diameter 2×9.928 μm and with as transverse diameter 2×29.789 μm.

Figure 13:
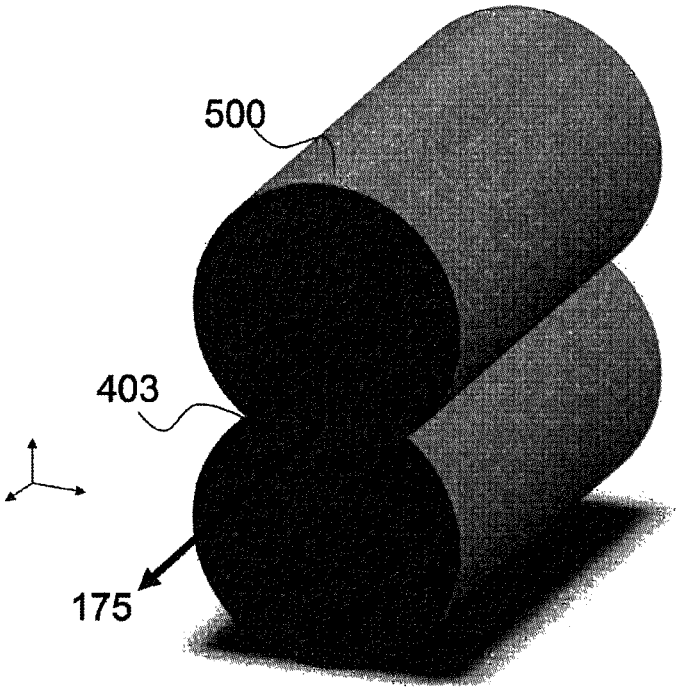
FIG. 13 illustrates a three-dimensional view of a nozzle and FIG. 15 is a section of this nozzle (500). The arrow (175) indicates the liquid flow (=jetting direction) through the nozzle (500) with a specific shape (403). The shape (403) of the outlet of the nozzle illustrates a preferred embodiment of the invention.

Nozzle 3 was similar as illustrated in FIG. 13. The shape of all sections in the nozzle was the composition of two circles with radius 12.5 μm and a cut plane distance from both circle centres was 9.949 μm. The area of the shape was 929.1169 $\mu m^2$ and the volume was 65038.18 $\mu m^3$. The maximum distance (D) from the outer edge ($O_E$) to the centre (c) of the minimum covering circle (C) was greater than the minimum distance (d) from the outer edge ($O_E$) to the centre (c) from the minimum covering circle (C) times 1.2.

Figure 14:
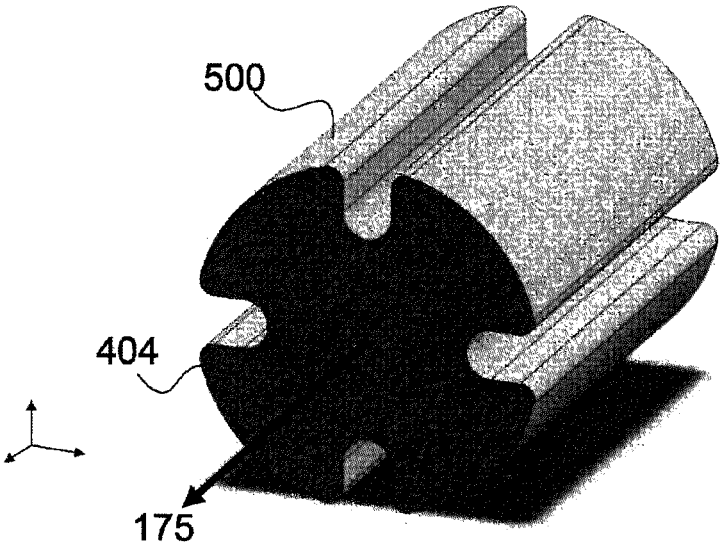
FIG. 14 illustrates a three-dimensional view of a nozzle and FIG. 16 is a section of this nozzle (500). The arrow (175) indicates the liquid flow through the nozzle (500) with a specific shape (404). The shape (404) of the outlet of the nozzle illustrates a preferred embodiment of the invention.
Figure 15:
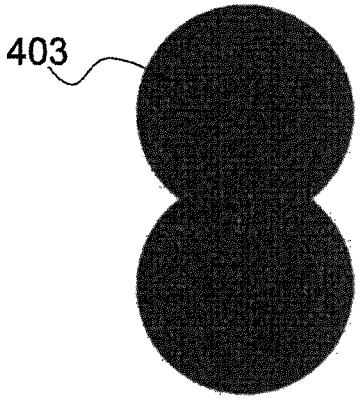
Figure 16:
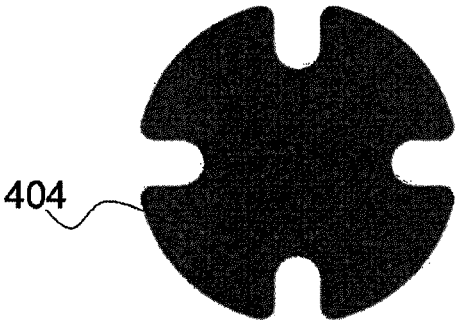
Figure 17:
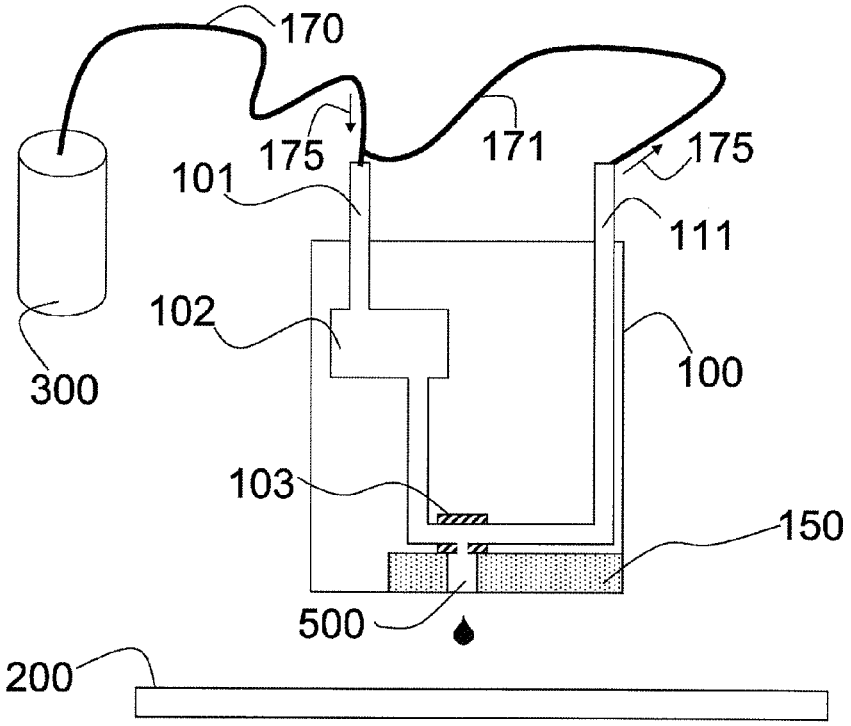
FIG. 17 illustrates a sectional of a printhead (100) wherein the liquid is recirculated and wherein the printhead (100) comprises a nozzle (500). The liquid is transported via a tube (170) from an external liquid feeding unit (300) in the flow direction (175) to a master inlet (101) of the printhead. The liquid is collected in a manifold (102). By the droplet forming means (103) the liquid is jetted through a small orifice in the droplet forming means and the nozzle (500) in the nozzle plate (150) of the printhead (100). The liquid is jetted on a receiver (200). The liquid is recirculated via a channel between the nozzle plate (150) and the liquid channel to a master outlet (111) in the flow direction (175) via a tube (171) wherein the liquid is transported back to the master inlet (101). The droplet forming means (103) comprising an actuator attached at a side of the liquid transport channel, opposing each other.
Figure 18:
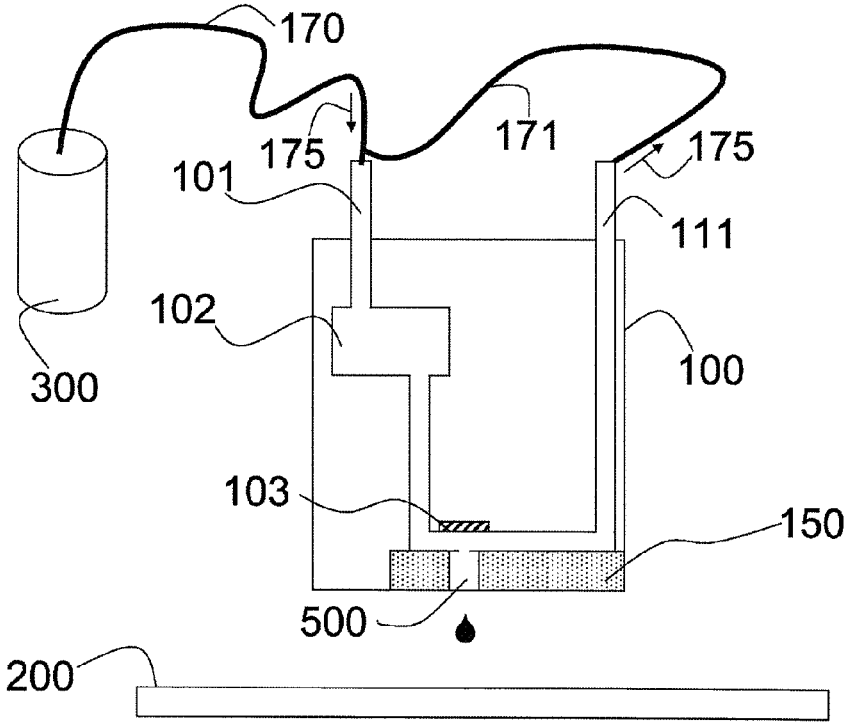
FIG. 18 illustrates a sectional of a printhead (100) wherein the liquid is recirculated and wherein the printhead (100) comprises a nozzle (500). The liquid is transported via a tube (170) from an external liquid feeding unit (300) in the flow direction (175) to a master inlet (101) of the printhead. The liquid is collected in a manifold (102). By the droplet forming means (103) the liquid is jetted through a small orifice in the liquid transport channel and the nozzle (500) which is comprised in the nozzle plate (150) of the printhead (100). The liquid is jetted on a receiver (200). The liquid is recirculated via a channel between the nozzle plate (150) and the liquid channel to a master outlet (111) in the flow direction (175) via a tube (171) wherein the liquid is transported back to the master inlet (101).

Nozzle 4 was similar as illustrated in FIG. 14. The shape of all sections in the nozzle has a maximum diameter of 17.809 μm. Each of the same four protrusions has a dimension of 5×5 μm. The area of the shape was 851.8 $\mu m^2$ and the volume was 59622.8 $\mu m^3$. The maximum distance (D) from the outer edge ($O_E$) to the centre (c) of the minimum covering circle (C) was greater than the minimum distance (d) from the outer edge ($O_E$) to the centre (c) from the minimum covering circle (C) times 1.2.

Nozzle 5: The shape of all sections in the nozzle was a square where each side was 30.48 μm. The area of the shape was 929.12 $\mu m^2$ and the volume was 65040 $\mu m^3$. Nozzle 51: The shape of all sections in the nozzle was a rectangle with a width of 43.108 μm and length 21.554 μm. Nozzle 52: The shape of all sections in the nozzle was a rectangle with a width of 52.796 μm and length 17.598 μm.

The four jettable liquids (Liquid 1, Liquid 2, Liquid 3, Liquid 4) had a surface tension of 32 mN/m and a density of 1000 $kg/m^3$.

The pressure at the inlet of the nozzle was changed in the examples depending on the shape of the nozzle so that the drop velocity at 500 μm nozzle distance was 6 m/s.

In the following table (Table 1) the pressure at the inlet of the nozzle in bar was determined for each nozzle example with a liquid of 50 mPa·s (Liquid 4) so the drop velocity at 500μ p (nozzle distance was 6 m/s.

TABLE 1

| Nozzle geometry | Pressure at the inlet of the nozzle |
|---|---|
| Nozzle 1 | 9.2 bar |
| Nozzle 2 | 11.3 bar |
| Nozzle 3 | 12.9 bar |
| Nozzle 4 | 16.6 bar |
| Nozzle 5 | 10.3 bar |

A nozzle distance is a distance of a jetted liquid droplet from the nozzle plate in the direction of the receiver.

In the following table (Table 2) the time in μs of the drop reaching a certain nozzle distance is shown for different nozzle distances in μm using a liquid of 50 mPa·s (Liquid 4) and a pressure at the inlet of the nozzle as defined in Table 1:

TABLE 2

| Nozzle distances | Nozzle 1 | Nozzle 2 | Nozzle 3 | Nozzle 4 | Nozzle 5 |
|---|---|---|---|---|---|
| 100 μm | 20 μs | 20 μs | 20 μs | 20 μs | 20 μs |
| 300 μm | 50 μs | 40 μs | 50 μs | 50 μs | 40 μs |

TABLE 2-continued

| Nozzle distances | Nozzle 1 | Nozzle 2 | Nozzle 3 | Nozzle 4 | Nozzle 5 |
|---|---|---|---|---|---|
| 500 μm | 80 μs | 80 μs | 80 μs | 80 μs | 80 μs |
| 700 μm | 110 μs | 110 μs | 120 μs | 120 μs | 110 μs |

The speed in m/s at a certain nozzle distance in μm can be found in the following table (Table 3) for each nozzle example with a liquid of 50 mPa·s (Liquid 4) and the pressure at the inlet of the nozzle as defined in Table 1:

TABLE 3

| Nozzle distances | Nozzle 1 | Nozzle 2 | Nozzle 3 | Nozzle 4 | Nozzle 5 |
|---|---|---|---|---|---|
| 100 μm | 8 m/s | 8 m/s | 7.75 m/s | 7.5 m/s | 8 m/s |
| 300 μm | 7 m/s | 6.6 m/s | 6.5 m/s | 6.15 m/s | 6.6 m/s |
| 500 μm | 6 m/s | 6 m/s | 5.75 m/s | 5.4 m/s | 6 m/s |
| 700 μm | 5.45 m/s | 5.5 m/s | 5.5 m/s | 5.15 m/s | 5.5 m/s |

In the following table (Table 4) the result of the nozzle geometry examples for the pinch-off-time in μs for each nozzle example with a liquid of 50 mPa·s (Liquid 4) and the pressure at the inlet of the nozzle as defined in Table 1. The pinch-off-time is smaller for Nozzle 2, Nozzle 3, Nozzle 4 and Nozzle 5 versus the nozzle geometry of the state of the art when using a high viscosity jetting method:

TABLE 4

| Nozzle geometry | Pinch-off-time |
|---|---|
| Nozzle 1 | 125 μs |
| Nozzle 2 | 75 μs |
| Nozzle 3 | 65 μs |
| Nozzle 4 | 65 μs |
| Nozzle 5 | 75 μs |

The following table (Table 5) is the result of the comparison of state of the art nozzle geometry (Nozzle 1) and elliptical nozzle geometry (Nozzle 2) wherein the different liquids (Liquid 1, Liquid 2, Liquid 3, Liquid 4) are examined versus the pinch-off-time in μs. The smaller the pinch-off-time, better the jetting performance, such as minimal amount of satellites what is the case for Nozzle 2.

TABLE 5

| Jetting liquid | Nozzle 1 | Nozzle 2 |
|---|---|---|
| Liquid 1: 10 mPa · s | 55 μs (inlet pressure: 1.6 bar) | 55 μs (inlet pressure: 1.8 bar) |
| Liquid 2: 20 mPa · s | 85 μs (inlet pressure: 3.1 bar) | 75 μs (inlet pressure: 3.6 bar) |
| Liquid 3: 30 mPa · s | 115 μs (inlet pressure: 4.9 bar) | 75 μs (inlet pressure: 5.9 bar) |
| Liquid 4: 50 mPa · s | 125 μs (inlet pressure: 9.2 bar) | 75 μs (inlet pressure: 11.3 bar) |

The following table (Table 6) is the result of the comparison of state of the art nozzle geometry (Nozzle 1) and elliptical nozzle geometry (Nozzle 2) wherein the different liquids (Liquid 1, Liquid 2, Liquid 3, Liquid 4) are examined versus the tail length in μm. Smaller the tail length of the jetted liquid, better the jetting performance such as minimal amount of satellites what is the case for Nozzle 2.

TABLE 6

| Jetting liquid | Nozzle 1 | Nozzle 2 |
|---|---|---|
| Liquid 1: 10 mPa · s | 275 μm (inlet pressure: 1.6 bar) | 275 μm (inlet pressure: 1.8 bar) |
| Liquid 2: 20 mPa · s | 475 μm (inlet pressure: 3.1 bar) | 425 μm (inlet pressure: 3.6 bar) |
| Liquid 3: 30 mPa · s | 675 μm (inlet pressure: 4.9 bar) | 450 μm (inlet pressure: 5.9 bar) |
| Liquid 4: 50 mPa · s | 775 μm (inlet pressure: 9.2 bar | 475 μm (inlet pressure: 11.3 bar) |

The following table (Table 7) is the result of the comparison of the state of the art nozzle geometry (Nozzle 1) versus rectangular nozzle geometry (RECT) with different aspect ratio's between width and height (Nozzle 5, Nozzle 51 and Nozzle 52) and the comparison of the state of the art nozzle geometry (Nozzle 1) versus elliptical nozzle geometry (ELLIPSE) with different aspect ratio's between the conjugate and transverse diameter (Nozzle 2, Nozzle 21) by using a liquid of 50 mPa·s (Liquid 4). The Table 7 includes the pressure at the inlet of the nozzle in bar so the drop velocity at 500 μm nozzle distance was 6 m/s, the pinch-off-time in μs and the tail length of the jetted liquid. Smaller the tail length of the jetted liquid, better the jetting performance such as minimal amount of satellites what is the case for Nozzle 2, Nozzle 21, Nozzle 5, Nozzle 51, Nozzle 52.

TABLE 7

| Nozzle geometry | Aspect Ratio | Shape | Pressure at the inlet of the nozzle | Pinch-off-time | Tail Length |
|---|---|---|---|---|---|
| Nozzle 1 | 1:1 | ELLIPSE | 9.2 bar | 125 μs | 775 μm |
| Nozzle 2 | 2:1 | ELLIPSE | 11.3 bar | 75 μs | 475 μm |
| Nozzle 21 | 3:1 | ELLIPSE | 15.2 bar | 65 μs | 425 μm |
| Nozzle 5 | 1:1 | RECT | 10.3 bar | 75 μs | 475 μm |
| Nozzle 51 | 2:1 | RECT | 12.6 bar | 75 μs | 475 μm |
| Nozzle 52 | 3:1 | RECT | 16.7 bar | 65 μs | 425 μm |

REFERENCE SIGNS LIST

TABLE 8

| | |
|---|---|
| 100 | Printhead |
| 101 | Master inlet |
| 102 | Manifold |
| 103 | Droplet forming means |
| 104 | Liquid channel |
| 111 | Master outlet |
| 150 | Nozzle plate |
| 170 | Tube |
| 171 | Tube |
| 175 | Flow direction |
| 200 | Receiver |
| 300 | External liquid feeding unit |
| 151 | Back side of a nozzle plate |
| 152 | Front side of a nozzle plate |
| 500 | Nozzle |
| 501 | Entrance of a nozzle |
| 502 | Exit of a nozzle |
| 550 | Sub-nozzle |
| 905 | A plane |
| 907 | A plane |
| 551 | Inlet |
| 552 | Outlet |
| 5521 | Outer edge |

TABLE 8-continued

| | |
|---|---|
| 5522 | Minimum covering circle of an outer edge |
| 5523 | Minimum distance from the outer edge to the centre of the minimum covering circle |
| 5524 | Maximum distance from the outer edge to the centre of the minimumc overing circle |
| 801 | Epicycloid |
| 802 | Epicycloid |
| 803 | Epicycloid |
| 811 | Fixed circle of an epicycloid |
| 812 | Fixed circle of an epicycloid |
| 813 | Fixed circle of an epicycloid |
| 821 | X-axes |
| 822 | Y-axes |
| 831 | Parameter box |
| 403 | A shape |
| 404 | A shape |
| 832 | Calculation box |

The invention claimed is:

1. A method for jetting a liquid comprising the steps of:

providing a piezoelectric printhead including a nozzle having a shape including an outer edge within a minimum covering circle, a maximum distance from the outer edge to a center of the minimum covering circle being greater than or equal to a minimum distance from the outer edge to the center of the minimum covering circle times 1.2;

jetting the liquid through the nozzle at a viscosity of 25 mPa·s to 1000 mPa·s; and recirculating the liquid through the piezoelectric printhead.

2. The jetting method according to claim 1, wherein the step of recirculating includes:

recirculating a continuous flow of the liquid through a liquid transport channel in the piezoelectric printhead; wherein a pressure is applied to the liquid by a droplet actuator in the piezoelectric printhead;

the nozzle is provided in a nozzle row of a nozzle plate in the piezoelectric printhead; and the liquid transport channel is in contact with the nozzle plate.

3. The jetting method according to claim 2, wherein the shape of the nozzle includes a set of axes of symmetry through the center of the minimum covering circle.

4. The jetting method according to claim 3, wherein an axis of symmetry of the set of axes of symmetry is parallel or perpendicular to a direction in which the nozzle row extends.

5. The jetting method according to claim 1, wherein the shape of the nozzle is:

an ellipse, an approximate ellipse, a rectangle, an approximate rectangle, a rounded rectangle, a substantially rounded rectangle, a rectellipse, an approximate rectangle, a semicircle, an approximate semicircle, a stadium, an approximate stadium, an oval, or an approximate oval;

a shape defined by a formula of an epicycloid; or a shape defined by a formula:

$$r(\theta) = \left[\left|\frac{\cos\left(\frac{1}{4}m\theta\right)}{a}\right|^{n2} + \left|\frac{\sin\left(\frac{1}{4}m\theta\right)}{b}\right|^{n3}\right]^{-1/n1}.$$

6. The jetting method according to claim 2, wherein the maximum distance from the outer edge to the center of the minimum covering circle is from 5 μm to 100 μm.

7. The jetting method according to claim 2, wherein the liquid is an inkjet ink including metallic particles or inorganic particles.

8. The jetting method according to claim 2, wherein the maximum distance from the outer edge to the center of the minimum covering circle is:

greater than or equal to the minimum distance from the outer edge to the center of the minimum covering circle times the square root of three;

greater than or equal to the minimum distance from the outer edge to the center of the minimum covering circle times the square root of four; or greater than or equal to the minimum distance from the outer edge to the center of the minimum covering circle times the square root of five.

9. The jetting method according to claim 2, wherein an area of the shape of the nozzle is between 50 $\mu m^2$ to 100 $\mu m^2$.

10. The jetting method according to claim 2, wherein a minimum drop size of one single droplet jetted from the nozzle is from 1 pL to 30 pL.

11. The jetting method according to claim 2, wherein a native print resolution from the piezoelectric printhead is from 150 DPI to 3600 DPI; and a jetting temperature of the liquid is between 10° C. and 100° C.

12. The jetting method according to claim 2, wherein the viscosity of the liquid is from 35 mPa·s to 70 mPa·s.

13. The jetting method according to claim 1, wherein the liquid is an aqueous curable inkjet ink, a UV curable inkjet ink, or a colorless inkjet ink.

14. The jetting method according to claim 13, wherein the liquid is the aqueous curable inkjet ink including an aqueous medium and polymer nanoparticles charged with a polymerizable compound.

15. The jetting method according to claim 14, wherein the polymerizable compound is selected from the group consisting of a monomer, an oligomer, a polymerizable photoinitiator, and a polymerizable co-initiator.

* * * * *